US006280111B1

(12) United States Patent
Armer et al.

(10) Patent No.: US 6,280,111 B1
(45) Date of Patent: Aug. 28, 2001

(54) APPARATUS AND METHOD FOR DISPENSING A CLEANING AGENT ONTO A CLEANING IMPLEMENT

(76) Inventors: Mark Armer, 9201 Independence Ave.; Frederick George Eiler, 10019 Mason Ave., both of Chatsworth, CA (US) 91311

( * ) Notice: Subject to any disclaimer, the term of this patent is extended or adjusted under 35 U.S.C. 154(b) by 0 days.

(21) Appl. No.: 09/627,510

(22) Filed: Jul. 28, 2000

Related U.S. Application Data

(63) Continuation-in-part of application No. 09/324,404, filed on Jun. 2, 1999, now Pat. No. 6,095,709.
(60) Provisional application No. 60/089,705, filed on Jun. 18, 1998.

(51) Int. Cl.[7] ..... A46B 11/00
(52) U.S. Cl. ..... 401/118; 401/123; 401/268; 222/205; 15/104.92
(58) Field of Search ..... 401/118, 123, 401/124, 125, 126, 127, 129, 268, 282, 130; 222/205, 195; 15/104.92, 104.93, 104.94

(56) References Cited

U.S. PATENT DOCUMENTS

| | | | | |
|---|---|---|---|---|
| 400,386 | * | 3/1889 | Armitstead | 222/44 |
| 721,112 | * | 2/1903 | Weaver et al. | 222/205 |
| 973,925 | * | 10/1910 | Downey | 222/205 |
| 1,158,785 | * | 11/1915 | Butcheck et al. | 222/205 |
| 1,573,036 | * | 2/1926 | Bowman | 401/130 |
| 2,529,003 | * | 11/1950 | De Witt et al. | 15/104.92 |
| 3,168,984 | * | 2/1965 | Corning et al. | 239/333 |
| 4,257,616 | * | 3/1981 | Pless | 15/230 |
| 4,275,970 | * | 6/1981 | Morrison et al. | 401/6 |
| 4,752,147 | * | 6/1988 | Persi | 401/126 |
| 5,945,076 | | 8/1999 | Leonard et al. . | |

* cited by examiner

*Primary Examiner*—Gregory L. Huson
*Assistant Examiner*—Huyen Le
(74) *Attorney, Agent, or Firm*—Ladas & Parry

(57) ABSTRACT

A dispenser is provided for dispensing liquid soap onto a scrub brush. The dispenser includes a reservoir for holding liquid soap, supporting surfaces for supporting the scrub brush in suspension above the liquid soap in the reservoir. In one embodiment, a carrier for holding the scrub brush is depressed by a downward force. The downward movement of the carrier enables even distribution of the liquid soap through the carrier to thereby coat an operative portion of the scrub brush. In another embodiment, a manually actuated pump dispenses the liquid soap upwardly through the bottom of a well onto the scrub brush.

3 Claims, 8 Drawing Sheets

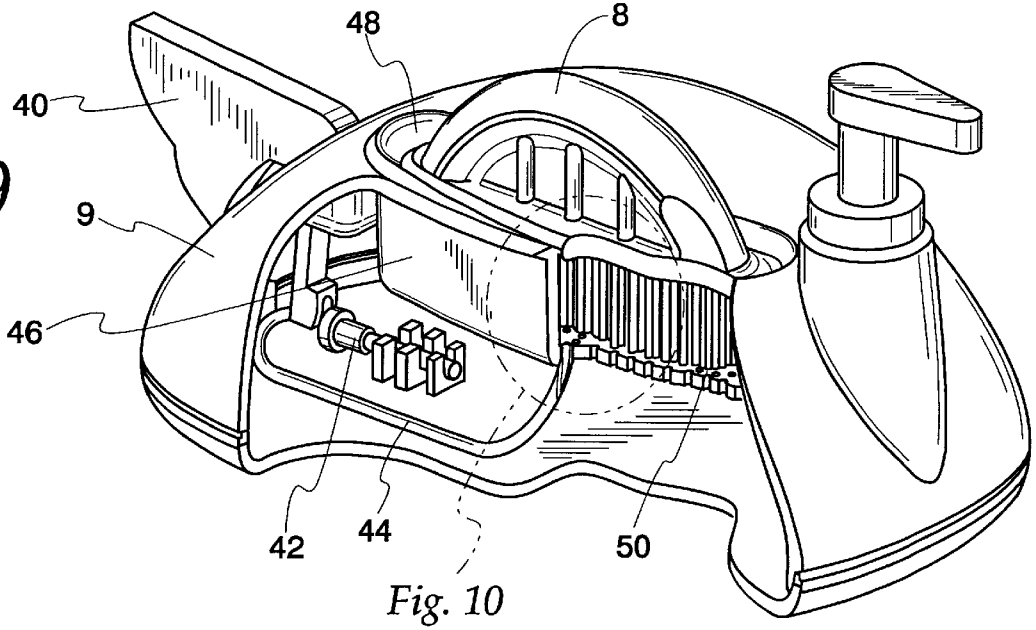
Fig. 9
Fig. 10
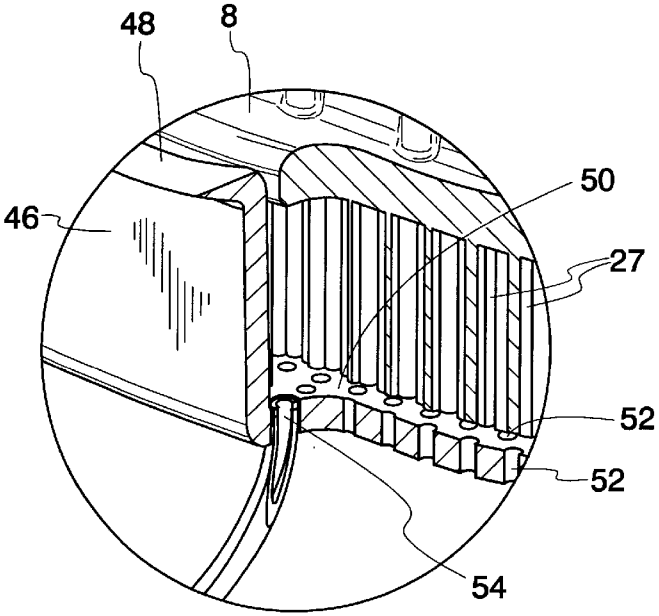
Fig. 10

APPARATUS AND METHOD FOR DISPENSING A CLEANING AGENT ONTO A CLEANING IMPLEMENT

This Application is a continuation-in-part of U.S. Application No. 09/324,404 filed Jun. 2, 1999 and now Pat. No. 6,095,709, which is based on U.S. provisional application U.S. Ser. No. 60/089,709, filed Jun. 18,1998.

BACKGROUND OF THE INVENTION

The present invention relates to a combination liquid soap dispenser and scrub brush, and in particular a liquid soap dispenser which has a carrier mechanism which delivers a hand/nail scrub brush into a bath of soap or other suitable cleaning agent. This carrier also acts as a suspension device which allows for drip-drying of the hand/nail scrub brush.

Hand/nail scrub brushes are commonly used items in our society, and are generally used for hygienic purposes. The scrub brushes are generally kept on a counter top, in a dish, or hung on some type of hook. In some cases the scrub brushes are quite unsightly.

To use liquid soap with a hand/nail scrub brush, the user generally deposits the liquid soap either on his/her hands or on the scrub brush bristles directly. In both cases, the liquid soap is not evenly distributed across the outer ends of the scrub brush bristles. This negatively affects the efficiency of the disinfecting and cleaning ability of the scrub brush, and can also unnecessarily waste liquid soap.

Once used, the scrub brushes are generally returned to their original positions. In the case of the first two locations, the bristles of the brush are usually placed in contact with a surface; this orientation often results in the development of a puddle of water around the brush bristles. The puddle often does not allow the brush to dry completely. In fact, the puddle itself can also facilitate the growth of bacteria.

Although many different liquid soap dispensers and scrub brushes are available, none of the liquid soap dispensers currently provide a housing for a scrub brush; as well as a mechanism that acts as both a suspension device for drip-drying and a delivery system for the brush to evenly distribute a coat of the liquid soap to the other ends of the scrub brush bristles.

SUMMARY OF THE INVENTIONS

The broad purpose of an embodiment of the present invention is to provide the means for the aesthetic housing of a hand/nail scrub brush, the mans for drip-drying the scrub brush, and the means for easily applying liquid soap to the hands and the hand/nail scrub brushes bristles evenly. In one embodiment of the present invention, the liquid soap dispenser has a standard pump on one side and an opening at the top. A carrier mechanism resides inside the liquid soap dispenser's hollow construction. The carrier is suspended or supported by springs. The scrub brush rests on the carrier's support pads. The brush's bristles are configured to minimize contact with the carrier. The carrier is guided in its movement, has grating on the main flat surface, and a perimeter wall completely outside the opening in the top of the housing.

In an additional embodiment of the present invention, the carrier may be separated into two separate components. The grating portion in the center of the carrier could be independent of the carrier support pads and walls. In this configuration the grating might use the Archimedes principle to float on the surface of the liquid soap or other suitable cleaning agent. The grating might also be guided in its movement. One guiding feature might be similar to the offset walls that guide the hand/nail scrub brush into the liquid soap, or a guiding feature similar to the guide bars that guide the carrier in its motion.

To use the described scrub brush, one need only press on the handle of the scrub brush. This action will cause the carrier to submerge into the liquid soap allowing the bristles to contact the aforementioned liquid soap. The preferred embodiment of the invention is to allow the user to house a scrub brush in an aesthetically pleasing fashion, the means to easily and evenly apply soap to the scrub brush, and the means for drip-drying the scrub brush. These all allow for greater ease of use, more convenience, potential cost savings in liquid soap, and can be manufactured and assembled at a relatively low cost.

In another embodiment an internal pump can be actuated to deliver soap to the scrub brush bristles.

Still further objects and advantages of the present invention will become readily apparent to those skilled in the art to which the invention pertains upon reference to the following detailed description.

DESCRIPTION OF THE DRAWING

The description refers to the accompanying drawings in which like reference characters refer to like parts throughout the several views and in which:

FIG. 9 is a perspective view of a third embodiment of the assembly;

FIG. 10 is a detailed fragmented view of the circled part of FIG. 9;

DESCRIPTION OF PREFERRED EMBODIMENT

Figure 1:
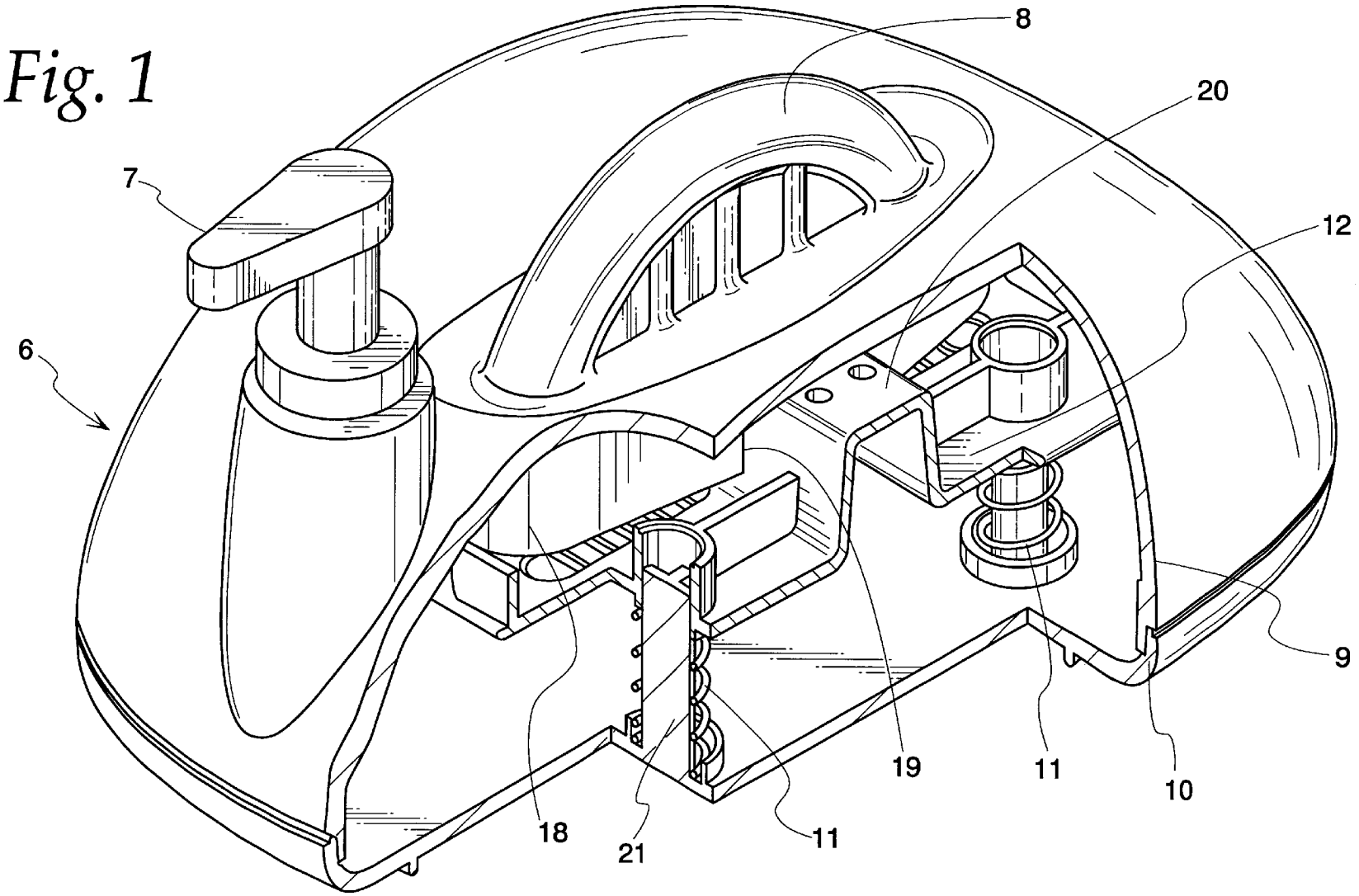
FIG. 1 is a perspective view of an improved combination liquid soap dispenser and hand/nail scrub brush assembly illustrating a first embodiment of the invention.
Figures 2, 3:
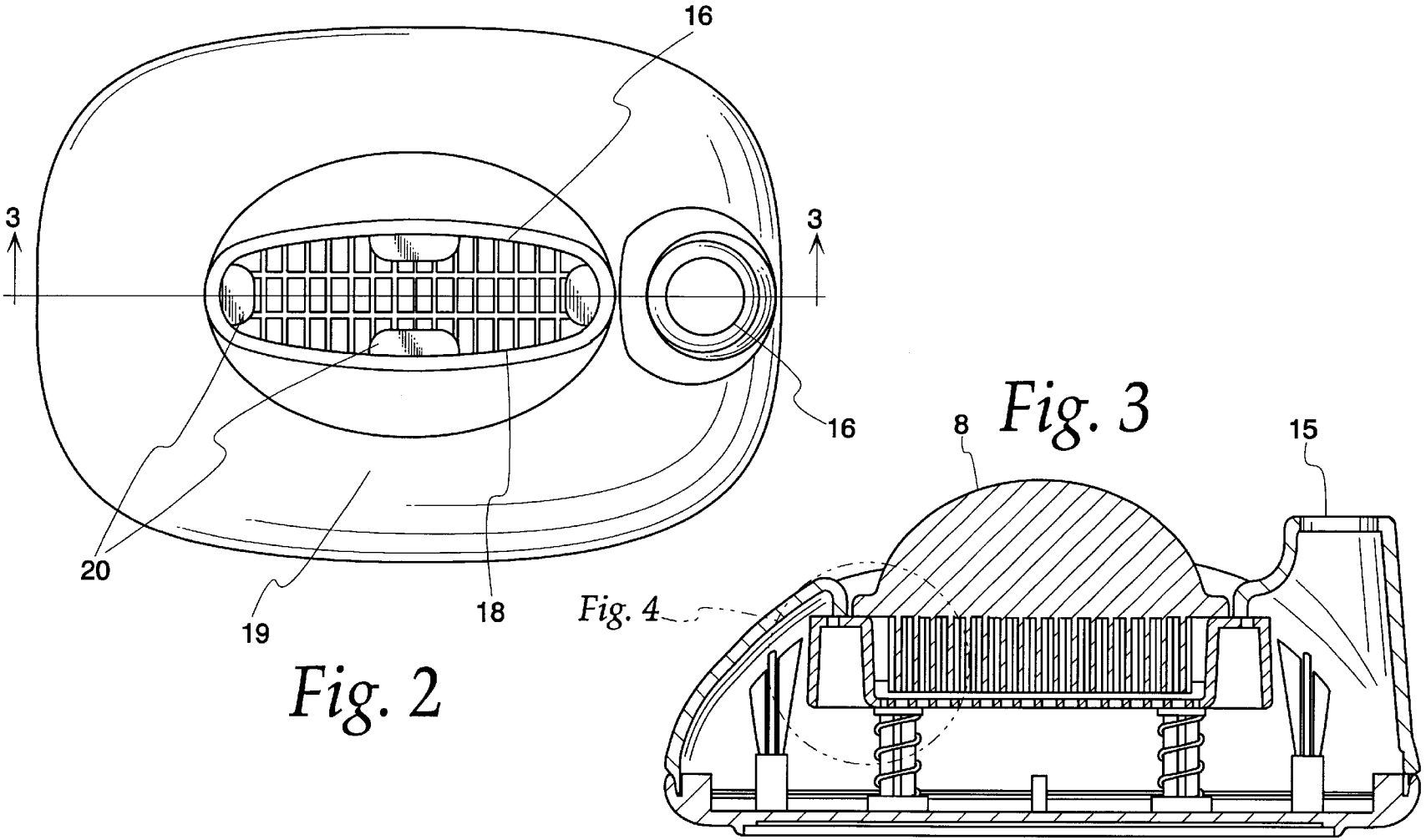
FIG. 2 is a top view or plan view of the assembly of FIG. 1, with the scrub brush removed.
FIG. 3 is a projected sectional view taken along line 3—3 in FIG. 2.
Figure 4:
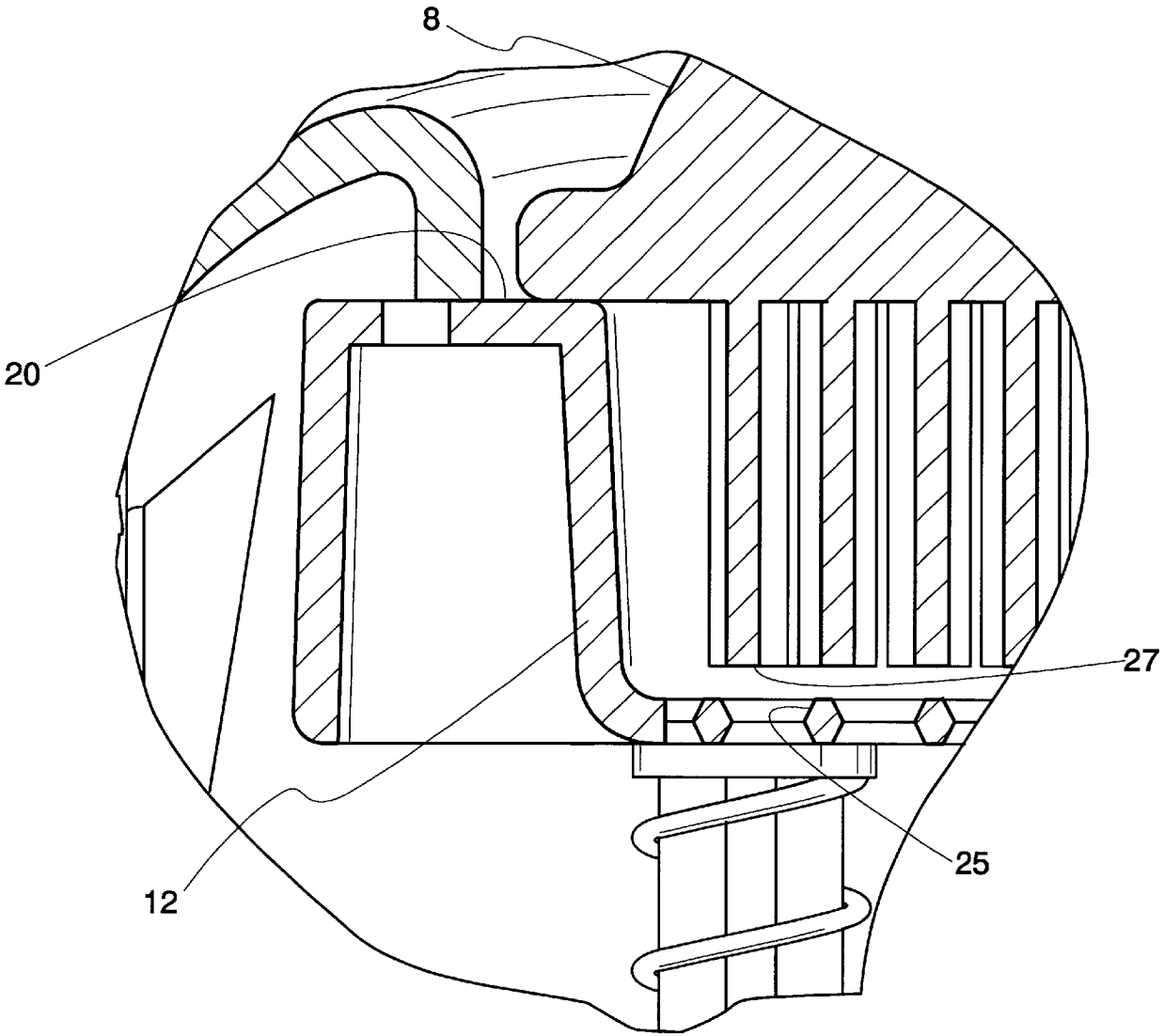
FIG. 4 is a detailed fragmented view of the circled part of FIG. 3.
Figure 5:
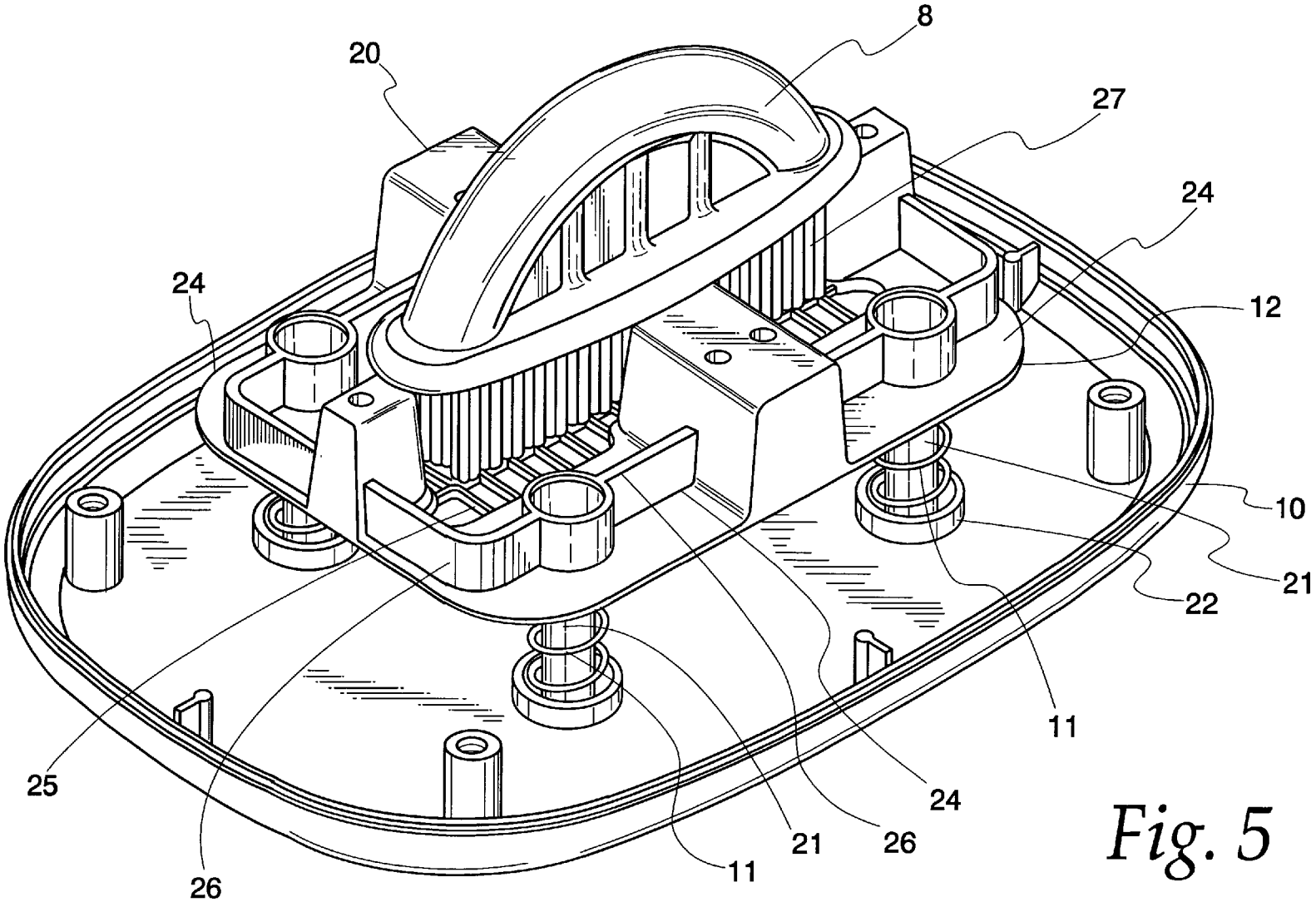
FIG. 5 is a perspective view of the assembly with top housing removed.

Referring to the drawings, FIG. 1 illustrates an embodiment of a combination of an improved liquid soap dispenser 6, a standard external pump assembly 7 and a hand/nail scrub brush 8.

The liquid soap dispenser 6 comprises an upper housing 9, a lower housing 10, springs 11, a carrier 12, and an optional external pump assembly 7. The upper 9 and lower 10 housings are bonded or welded together to produce a reservoir for the liquid soap.

Referring to FIGS. 2–5, the upper housing 9 has a hole 15 for the pump assembly 7, and a cutout portion 16 in the upper housing for the hand/nail scrub brush 8. The cutout portion 16 is an offset of the outside shape of the hand/nail scrub brush 8; this provides a locating feature for the hand/nail scrub brush 8. The sidewalls 18 of the cutout 16 have clearance slots 19 for the carrier support pads 20.

The lower housing 10 has a set of vertical guide bars 21 that locate the carrier 12. Surrounding these guide bars 21 are cylindrical walls 22, which locate the springs 11. These springs 11 support the carrier 12, and provide the necessary return force for the carrier 12 during the liquid soap application to the hand/nail scrub brush 8.

The carrier's 12 shape consists mainly of a flat plate 24. The center of the flat plate 24 preferably has a grated area 25. The grated area 25 allows for the flow of liquid soap through the carrier. The grated area 25 is surrounded by a retaining wall 26. There are four flanges or brush support pads 20 extending horizontally from the wall 26. These support pads 20 are located above the grated area 25 to keep scrub brush bristles 27 from contacting the grated area 25 surface. The support pads 20 thus allow the scrub brush 8 to drip-dry effectively. Pressing down on the handle of the soap brush 8 will apply a downward force via pads 20 to the carrier, thus bringing the scrub brush bristles 27 into contact with liquid soap in the reservoir.

In operation, the user simply pushes down on the brush 8, which is resting upon the carrier pad 20, against the force of coil springs 11, to allow the brush and carrier to be lowered into the dispenser so that the bottom of the bristles will be applied with an even coating of liquid soap contained within the reservoir. By releasing pressure, the springs will elevate the brush for the operator to remove. After use, the brush is rinsed off and replaced on the carrier support pads 20, with the lower ends of bristles 27 extending above the grated area 25 of the carrier 12 so that the brush 8 is suspended for drip-drying of the bristles 27.

Figure 6:
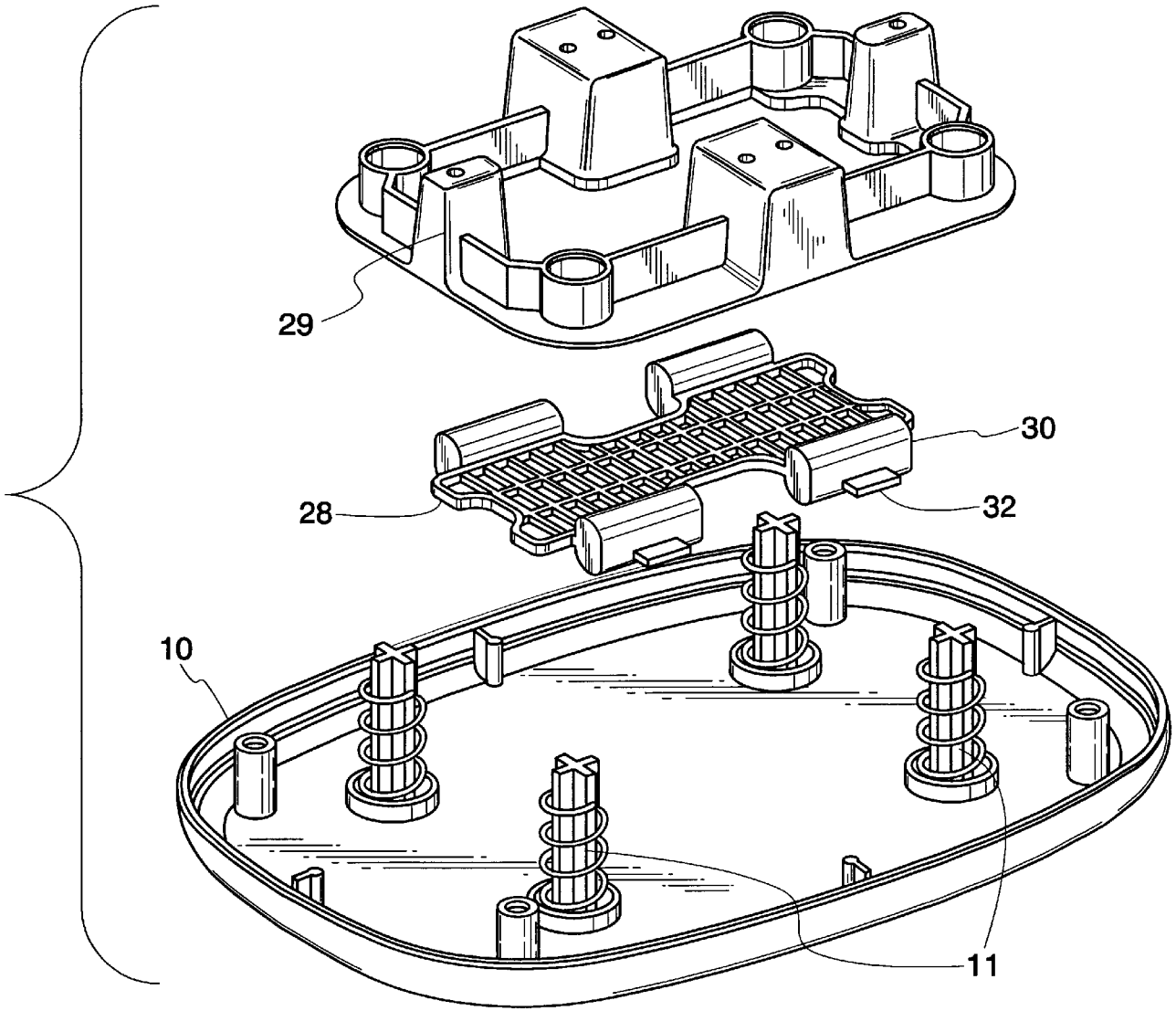
FIG. 6 is an exploded perspective view of a second embodiment showing only the lower housing, springs, and the carrier separated into two components (grating and support structure)
Figures 7, 8:
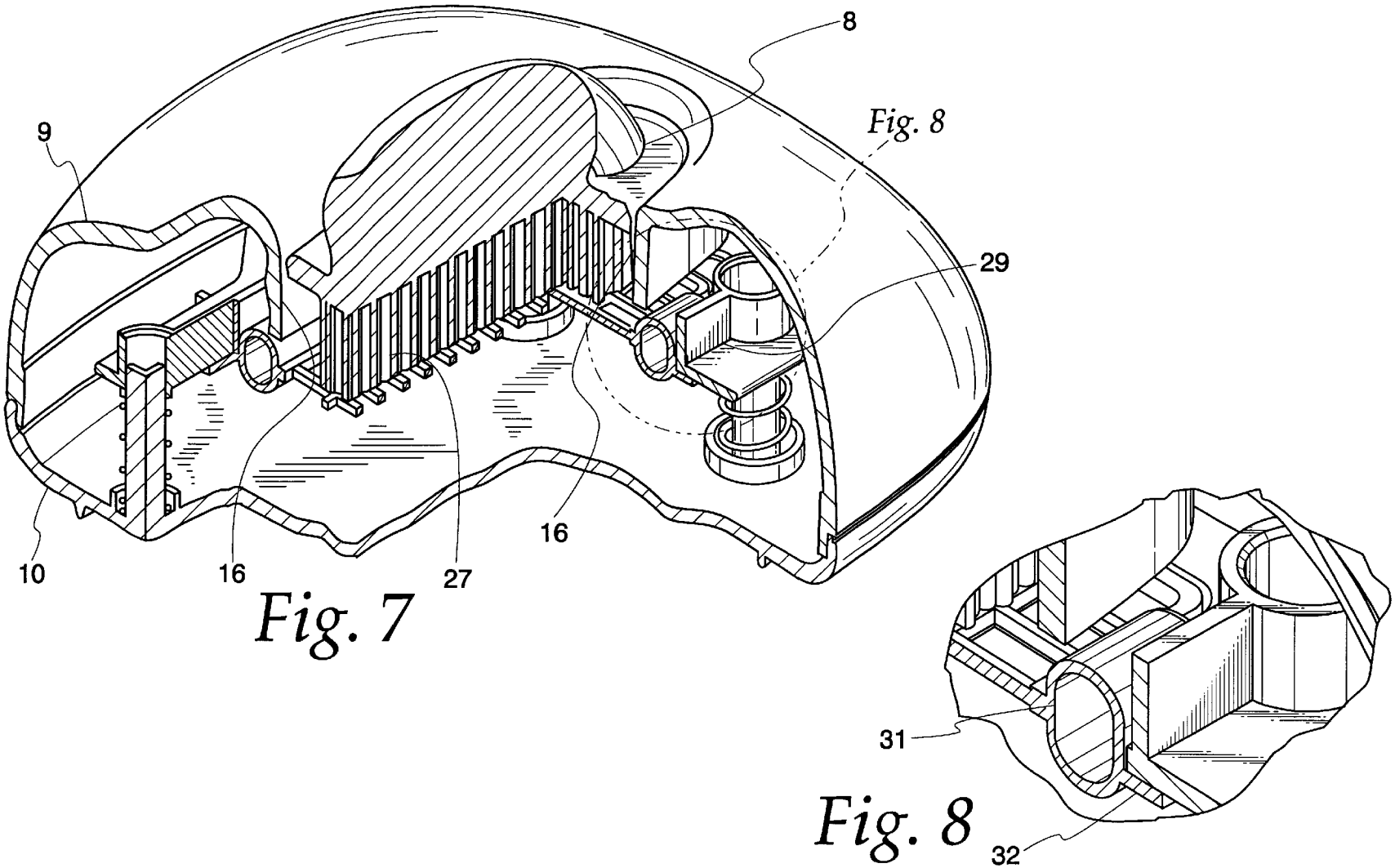
FIG. 7 is a perspective partial cross-sectional view illustrating the second embodiment.
FIG. 8 is a detailed fragmented view of the circled portion of FIG. 7.
Figure 11:
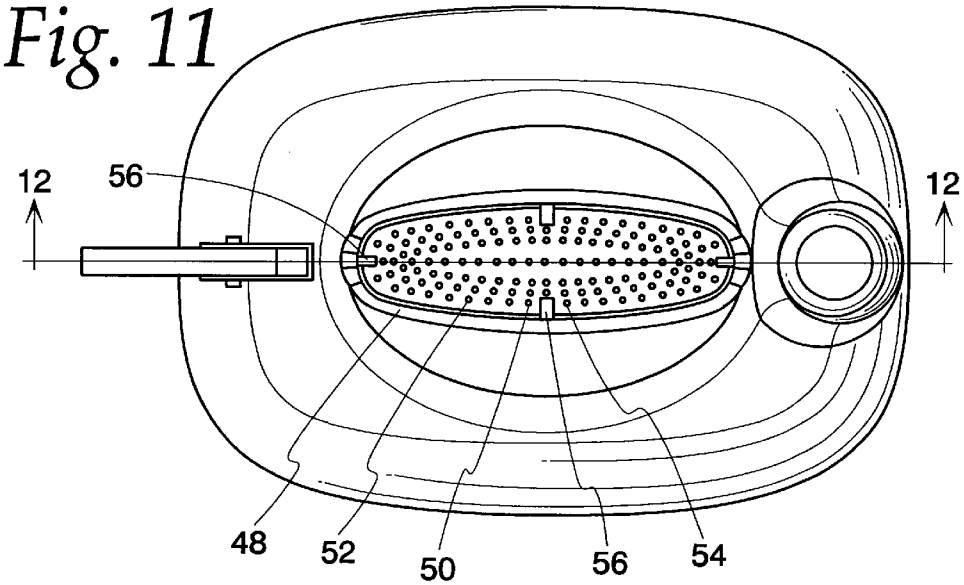
FIG. 11 is a top plan view of the embodiment of FIG. 9, with the scrub brush removed.
Figure 12:
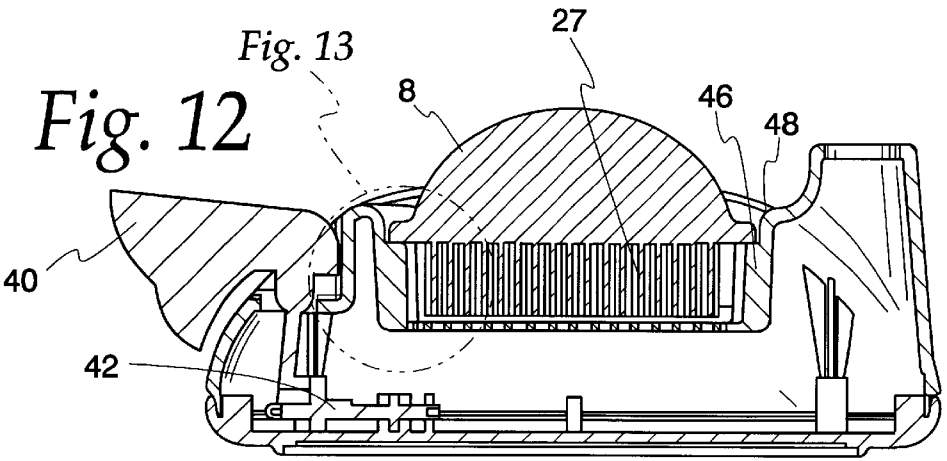
FIG. 12 is a projected sectional view taken along line 12—12 in FIG. 11.
Figure 13:
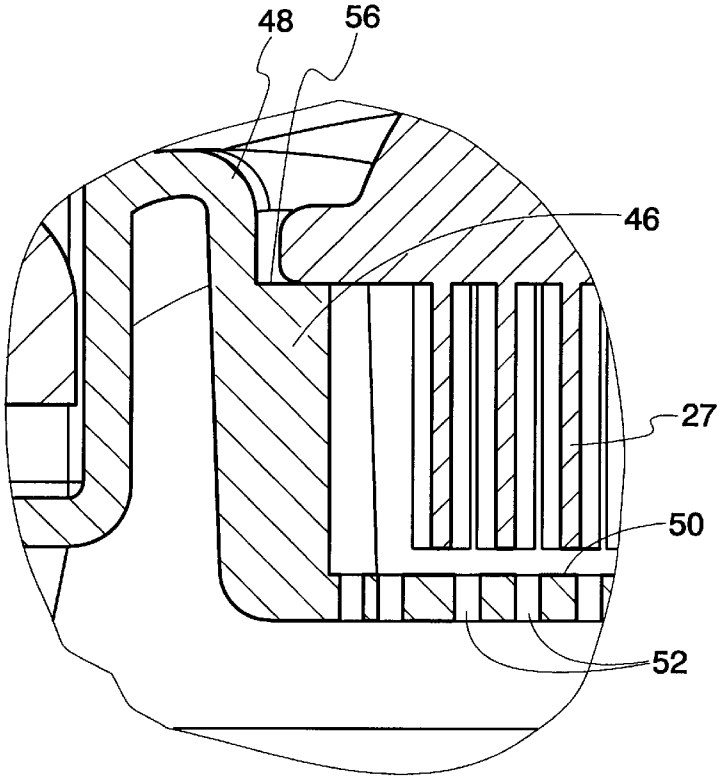
FIG. 13 is a detailed fragmented view of the circled part of FIG. 12.

Referring to FIGS. 6 to 8, in a second embodiment, the carrier 12 may be separated into two parts comprised of grating 28 and support structure 29. The grating 28 portion may have features that assist its floatation, such as buoys 30. The buoys 30 preferably would have a hollow interior portion 31. The grating 28 floatation would be based on the Archimedes Principle. The support structure 29 would operate in the same fashion as the one-piece carrier 12. In this alternative form, features can be added to either the grating 28 or the support structure 29 to keep the hand/nail scrub brush bristles 27 from contacting the grating 28. One example would be outward flanges 32 extending from the buoys 30. The support structure 29 would contact the flanges 32 to prevent the hand/nail bristles 27 from contacting grating 28.

Another embodiment is illustrated in FIGS. 9–13. In this embodiment the need for a separate carrier has been eliminated in favor of a separate manually operable pump means to force liquid soap up to the bristles 27 of the scrub brush 8 as shown in FIG. 9. A manually operable lever 40 actuates an internal pump 42 located within the bottom of the reservoir. The pump output is connected by way of plastic tubing 44 to enable the supply of liquid cleaning agent into the space occupied by the scrub brush 8. In this embodiment the upper housing 9 includes a cutout portion 48 adapted to accommodate the scrub brush 8. Instead of a separate carrier and related components, in this embodiment there is an integral well 46 located in the center portion of upper housing 9 which provides a recess area to accommodate the scrub brush 8. The well 46 has a bottom surface 50 with a plurality of drainage holes 52 and an inlet orifice 54. The pump tubing 44 supplies liquid through the inlet 54 into the space occupied by the scrub brush 8.

The well 46 is provided with several brush support flange-like surfaces 56 to support the scrub brush 8 in a position whereby the bristles 27 are suspended above the bottom wall 50 of the well 46. By pumping the lever 40 an operator will actuate the pump 42 thereby supplying liquid cleaning agent such as liquid soap through the tubing 44 to the well inlet 54 to thereby cover the bottom portions of the bristles 27 with an even coating. The pumping of the lever can be repeated as necessary to cover the ends of the scrub brush bristles as desired by the operator.

The relative size of the drainage holes 52 in contrast to the supply inlet 54 is such that the flow of liquid supplied through the tubing 44 and inlet 54 will exceed the drainage from the plurality of holes 52.

This embodiment provides an advantage in eliminating a separate carrier structure while allowing an operator to depress the handle 40 sufficiently to evenly coat the bottom of the brush bristles 27, as in the case of the previously described embodiments. Similarly, by supporting the brush above of the bottom of the well 46 the bristles are suspended to enable drip-drying.

It is understood that modifications may be made within the scope of the invention as defined by the accompanying claims.

What is claimed is:

1. An apparatus for dispensing a liquid onto a cleaning implement which comprises:

a container having a lower portion defining a reservoir for holding a liquid cleaning agent, said container having an opening in an upper portion for locating and holding a cleaning implement;

a recess area below said opening in the form of a well located within and as part of said container; said well including a planar bottom wall provided with a plurality of holes;

means for supporting said cleaning implement in suspension above said bottom wall;

pump means mounted within said container in the lower portion thereof below said well;

conduit means communicating said pump means to the bottom portion of said well to enable supply of liquid into said well; and manually operable means mounted on the outside of said container and coupled to actuate said pump means;

whereby actuation of said pump means will enable supply of liquid cleaning agent from said reservoir upwardly into said well to contact at least a lower portion of said cleaning implement with a substantially uniform amount of liquid cleaning agent;

said plurality of holes in the bottom wall of said well permitting drainage of liquid cleaning agent from said well back into said reservoir after use.

2. The apparatus of claim 1 in which said bottom wall of said well includes an inlet opening communicating via said conduit means to said pump means to enable supply of liquid cleaning agent into said well.

3. The apparatus of claim 2 wherein said inlet opening has a size relative to the plurality of holes to enable the flow of liquid into said well to exceed the outward flow of said liquid from said well through said plurality of holes.

* * * * *